United States Patent [19]

Claghorn et al.

[11] Patent Number: 4,700,031

[45] Date of Patent: Oct. 13, 1987

[54] TRIGGER AND SWITCH ASSEMBLY

[75] Inventors: Roger O. Claghorn, Florissant; James I. Metzger, Jr., Manchester, both of Mo.

[73] Assignee: Emerson Electric Co., St. Louis, Mo.

[21] Appl. No.: 857,169

[22] Filed: Apr. 29, 1986

[51] Int. Cl.[4] ..... H01H 13/08; H01H 1/28; H01H 1/24

[52] U.S. Cl. ..... 200/153 LA; 200/157; 200/293; 200/283; 200/281; 200/159 A

[58] Field of Search ..... 200/153 LA, 157, 159 A, 200/281, 283, 293, 303, 1 A, 6 BB, 271, 280, 291

[56] References Cited

U.S. PATENT DOCUMENTS

| | | | |
|---|---|---|---|
| 2,816,977 | 12/1957 | de Kramer | 200/153 LA X |
| 3,117,206 | 1/1964 | Bush | 200/157 |
| 3,145,275 | 8/1964 | Gilbart | 200/153 LA X |
| 3,564,372 | 2/1971 | Vogelsberg et al. | 200/157 |
| 3,671,699 | 6/1972 | Matthews | 200/157 |
| 3,676,627 | 7/1972 | Happe | 200/159 A |
| 3,712,970 | 1/1973 | Adie | 200/157 X |
| 3,904,844 | 9/1975 | Sahrbacker | 200/157 |
| 4,054,766 | 10/1977 | Kramer | 200/157 |

*Primary Examiner*—Stephen Marcus
*Assistant Examiner*—Ernest G. Cusick
*Attorney, Agent, or Firm*—Polster, Polster and Lucchesi

[57] ABSTRACT

An interchangeable switching system for an electrical device includes a trigger, first and second electrical contacts, and first and second interchangeable housings for mountably receiving the trigger and the contacts. The trigger has first and second camming surfaces and the first housing includes structure for mounting the first and second electrical contacts such that inward movement of the trigger causes the first contact to be forced by the first camming surface into electrical contact with the second contact. The second housing includes structure for mounting the first and second contacts in positions in which a predetermined inward movement of the trigger causes the first contact to be forced by the first camming surface into contact with a third electrical contact disposed in this housing between the first and second contacts. The third contact is positioned such that an additional predetermined travel of the trigger inwardly causes the third contact to be forced by the second camming surface out of engagement with the first contact and into engagement with the second electrical contact.

36 Claims, 7 Drawing Figures

TRIGGER AND SWITCH ASSEMBLY

BACKGROUND OF THE INVENTION

This invention relates generally to electrical devices such as soldering irons or guns (hereinafter collectively called soldering irons) and electric drills and more particularly to an improved trigger and switch assembly for such electrical devices.

Present electrical devices such as soldering irons and electric drills often are available in two related models: one having a on/off switch only and the other having an "off" position and two "on" positions (Low and High for example). Heretofore these related models have required different switch assemblies, and each of these switch assemblies have contained a relatively large number of parts. This unnecessarily increased the cost of the switch assemblies themselves and the cost of manufacturing the electrical devices containing them. Furthermore, the fast that different switch assemblies were needed for related models results in increased inventory requirements.

SUMMARY OF THE INVENTION

Among the various objects and features of the present invention may be noted the provision of an improved trigger and switch assembly which is readily adapted to related models of electric devices.

A second objects of the present invention is the provision of such a trigger and switch assembly which uses common parts for related models of electrical devices.

A third object of the present invention is the provision of such a trigger and switch assembly which readily provides both on/off and three position capabilities.

A fourth object of the present invention is the provision of such a trigger and switch assembly with reduced parts count.

A fifth object of the present invention is the provision of such a trigger and switch assembly that is relatively low in cost.

A sixth object of the present invention is the provision of such a trigger and switch assembly that is relatively easy to assemble.

Other objects will be in part apparent and in part pointed out hereinafter.

Briefly, an improved trigger of the present invention for an electrical device such as a soldering iron or an electric drill includes an integral trigger body having a finger receiving surface formed in one end thereof and forming the front of the trigger, the exertion of manual pressure on the finger receiving surface causing the trigger body to move inwardly with respect to the electrical device housing. The trigger body includes a first camming surface integrally formed therein, the first camming surface being disposed generally rearwardly with respect to the finger receiving surface and being shaped so as to force any electrical contact with which it becomes operatively engaged in a first direction. A second camming surface is integrally formed in the trigger body, the second camming surface being disposed between the first camming surface and the finger receiving surface and being further disposed in the first direction with respect to the first camming surface. The second camming surface is shaped so as to force any electrical contact with which it becomes operatively engaged in the first direction, away from any contact operatively engaged by the first camming surface. The trigger further includes guide grooves integrally formed in the trigger body for guiding the trigger in a relatively straight path with respect to the housing upon the application of manual pressure to the finger receiving surface. In addition a spring retention surface is integrally formed in the trigge body to retain one end of a return spring so that the return spring may force the trigger back to its rest position upon the removal of manual pressure.

In a second embodiment of the present invention, an interchangeable switching system for an electrical device such as a soldering iron or an electric drill includes a trigger having a finger receiving surface formed therein and forming the front of the trigger, first and second electrical contacts, and first and second interchangeable housings for mountably receiving the trigger and the contacts. The trigger is movable inwardly with respect to the housing in which it is mounted by the application of manual pressure to the finger receiving surface. The trigger has first and second camming surfaces accessible from inside the housing in which the trigger is mounted. The first housing includes structure for mounting the first and second electrical contacts in positions in which inward movement of the trigger with respect to the first housing causes the first contact to engage the first camming surface, the first contact being forced by the first camming surface in a first direction perpendicular to the line of travel of the trigger. The second contact is disposed in the first direction with respect to first contact a distance no greater than the length of travel of the first contact, whereby engagement of the first contact with the first camming surface cuases the first and second electrical contacts to come into physical contact for the flow of current therethrough. The first housing mounting structure disposes the second contact at such a position that it remains free of operative engagement of either camming surface of the trigger. The second housing includes structure for mounting the first contact in a position in which a predetermined inward movement of the trigger with respect to the second housing causes the first contact to engage the first camming surface, the first contact being forced by the first camming surface in the first direction. The second contact is disposed in the first direction with respect to the first contact a distance greater than the length of travel of the first contact, whereby the first and second contacts remain out of physical contact. The system further includes a third electrical contact, the second housing mounting structure including structure for mounting the third contact intermediate the first and second contacts at a position in which the third contact is in physical contact with the first contact when the first contact is forced in the first direction by the first camming surface. The third contact is positioned such that an additional predetermined travel of the trigger inwardly causes the third contact to be engaged by the second camming surface, the second camming surface forcing the third contact in the first direction out of physical contact with the first electrical contact and into physical contact with the second electrical contact.

In a third embodiment of the present invention, a switching system incorporated in an electrical device such as a soldering iron or an electric drill includes a trigger having a finger receiving surface formed in the front thereof, first, second and third electrical contacts, and a housing for mountably receiving the trigger and the contacts. The trigger is movable inwardly with respect to the housing by the application of manual pressure to the finger receiving surface and has first and second camming surfaces accessible from inside the housing. The housing includes structure for mounting the first, second, and third electrical contacts in positions in which inward movement of the trigger a first distance with respect to the housing causes the first contact to engage the first camming surface, the first contact being forced by the first camming surface in a first direction perpendicular to the line of travel of the trigger. The second and third contacts are disposed in the first direction from the first contact, the third contact being disposed intermediate the first and second contacts at a position in which it is in physical contact with the first contact when the first contact is forced in the first direction by the first camming surface. The third contact is positioned such that an additional inward movement of the trigger a predetermined distance causes the third contact to be engaged by the second camming surface, the second camming surface forcing the third contact in the first direction out of physical contact with the first electrical contact and into physical contact with the second electrical contact.

BRIEF DESCRIPTION OF THE DRAWINGS

Similar reference characters indicate similar parts throughout the several views of the drawings.

DESCRIPTION OF THE PREFERRED EMBODIMENT

Figure 3:
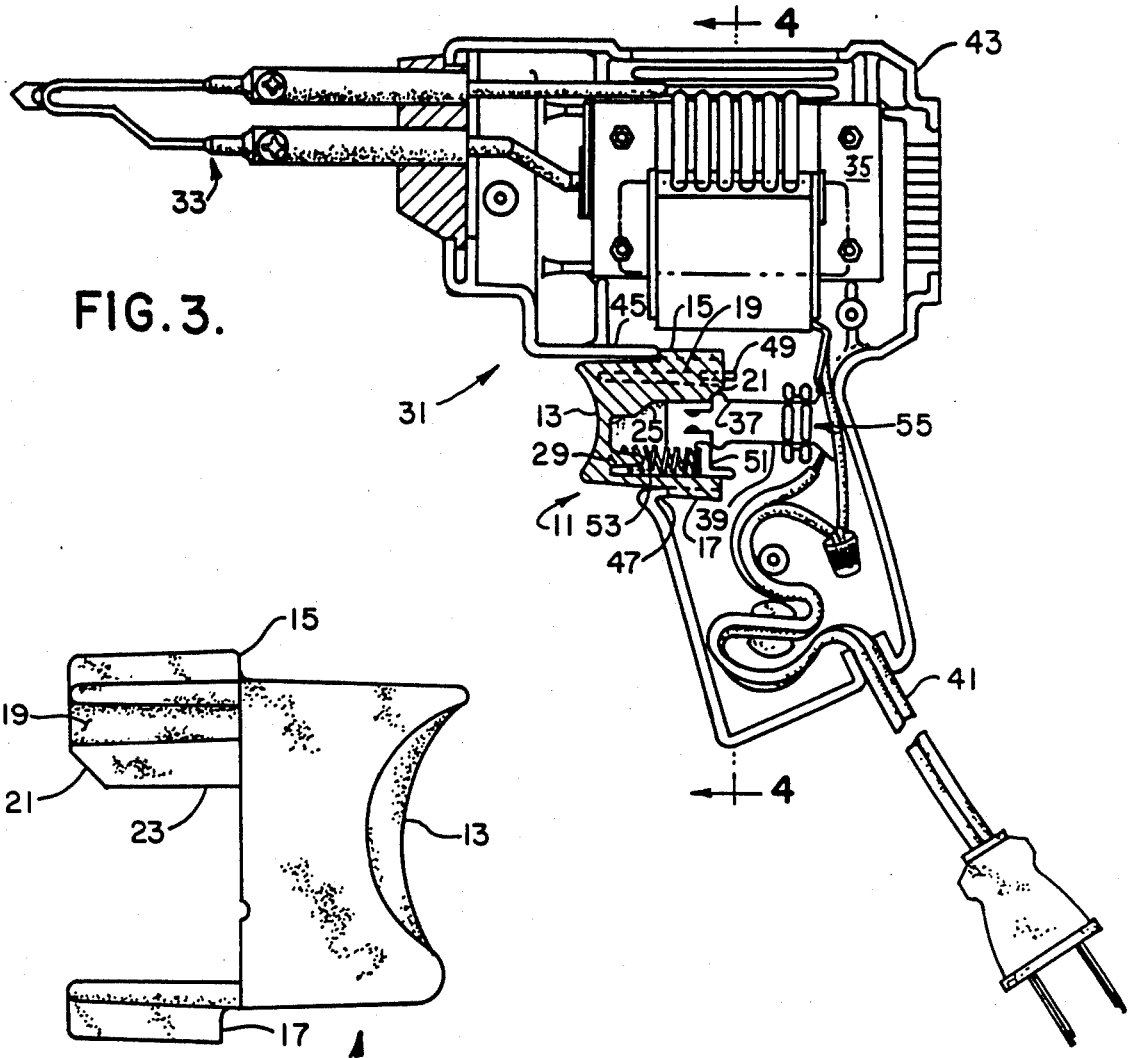
FIG. 3 is a cross sectional elevation of a one-temperature soldering iron incorporating the improved trigger and switch assembly of the present invention.

Trigger 11 of the present invention is an integral molded part of a suitable material such as nylon. It includes a finger receiving surface 13 disposed at the front of the trigger body. Rearwardly of the finger receiving surface, trigger 11 includes a pair of stops 15 and 17 disposed at the top and bottom of the trigger and centered thereon. Below top stop 15 a pair of guiding grooves 19 are integrally formed in the body of trigger 11 on each side of the trigger. Immediately below the guiding grooves and extending forwardly and inwardly from the rear of the trigger is a first camming surface 21, which camming surface is centered with respect to the sides of the trigger.

Figure 1:
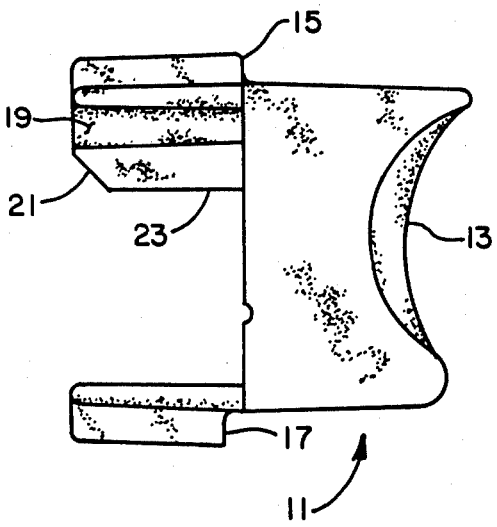
FIG. 1 is a side elevation of an improved trigger of the present invention.
Figure 2:
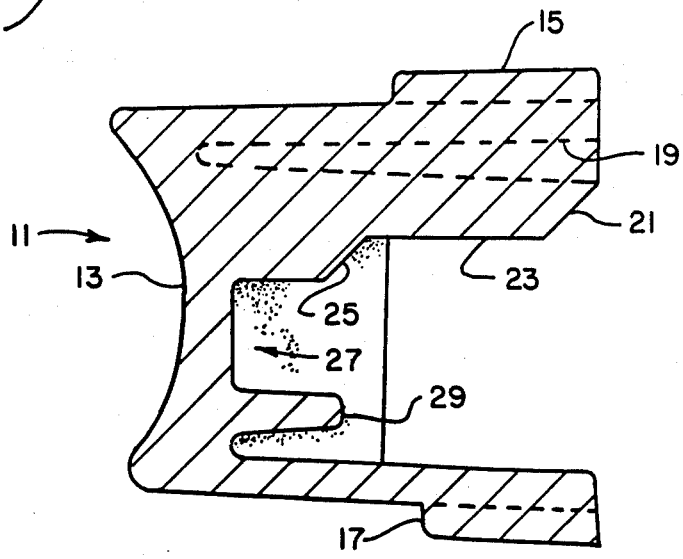
FIG. 2 is a cross sectional view of the improved trigger showing interior detail.

As seen in FIGS. 1 and 2, the interior of trigger 11 is generally hollow for reasons which appear below. First camming surface 21 originates generally at the rear of the trigger and slopes in a first direction (perpendicular to the line of travel of the trigger) and toward the front of the trigger. It terminates at its most forward extent in a flat surface 23 which is generally parallel to groove 19 and to the line of travel of trigger 11 when it is installed in a soldering iron or the like. Flat surface 23 terminates at its forward end, i.e. the end closer to the front of the trigger, in a second cammind surface 25 (FIG. 2) of generally the same size and shape as first camming surface 21. Camming surface 25 in turn terminates in an interior hollow 27 adjacent the front of trigger 11. Immediately below hollow 27, trigger 11 has formed integrally therein a return spring retaining cone 29.

Figure 4:
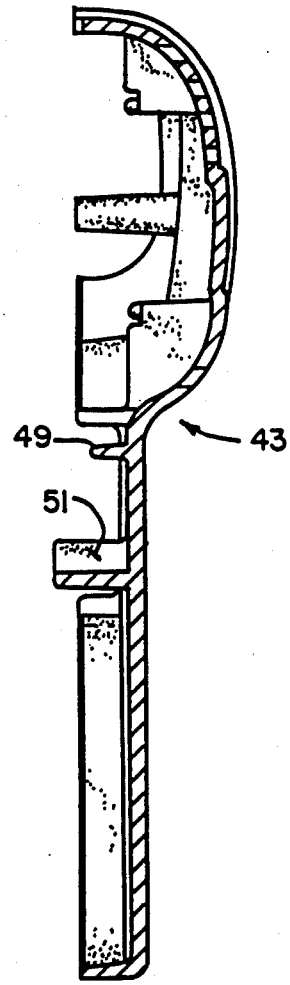
FIG. 4 is a cross sectional view taken along line 4—4 of FIG. 3 with parts removed for clarity.

Trigger 11 is especially suited for use in an electrical device such as a soldering iron (FIG. 3), which iron includes a heating element 33, a transformer 35, a pair of phosphor bronze leaf spring contacts 37 and 39, and a power cord 41, all suitably mounted in or to a device housing 43. Contacts 37 and 39 may each optionally have a detent formed therein to provide an audible noise or click when the contact is cammed. Housing 43 is preferably molded of ABS plastic and has integrally formed therein stop engaging surfaces 45 and 47 for engaging trigger stops 15 and 17, a pair of guiding ribs 49 (one on each side of the housing) extending out from the housing walls into grooves 19 on each side of the trigger and forming a track for the trigger, and a spring abutting surface 51 extending out from one wall of the housing. One of the guiding ribs 49 and the back of spring abutting surface 51 are shown more clearly in FIG. 4. Spring abutting surface 51 (FIG. 3) has a lip which overhangs one end of a return spring 53 and, in combination with spring retention cone 29, holds the return spring in place inside the housing. Application of manual pressure on finger receiving surface 13 of trigger 11 causes the trigger to move to the right with respect to the housing (when the soldering iron is in the orientation shown in FIG. 3), and the return spring returns the trigger to its rest position shown in FIG. 3 when the manual pressure is released.

Housing 43 also has integrally formed therein a set of six mounting lugs 55 arranged in three rows of two columns. Lugs 55 provide the mounting surfaces for first and second contacts 37 and 39. Preferably the contacts have positioning dimples formed in their surfaces to accurately position the contacts with respect to the mounting lugs and frictionally hold them in place. More specifically, the spacing between the lugs is such that first contact 37 is held in a position where it can be cammed downwardly by camming surface 21, when trigger 11 is pressed, an amount sufficient to make physical and electrical contact with second contact 39. Lugs 55 hold the second contact in such a position that it never engages the camming surfaces of the trigger. As the trigger is pressed, second contact 39 enters further into the hollow interior of the trigger, but it never strikes the trigger itself. Trigger 11 may be pulled inwardly until further inward travel is stopped by spring abutting surface 51.

First contact 37 is suitably connected to one side of the primary winding of transformer 35. The other side of the primary winding is suitably connected to one side of power cord 41. Second contact 39 is suitably connected to the other side of the power cord. As a result, when physical contact is made between the first and second contacts, current flow through the primary winding of transformer 35 and a corresponding heating current flow through heating element 33 of the soldering iron. Contacts 37 and 39 in combination with trigger 11 thus make an on/off switch assembly for soldering iron 31.

Figure 5:
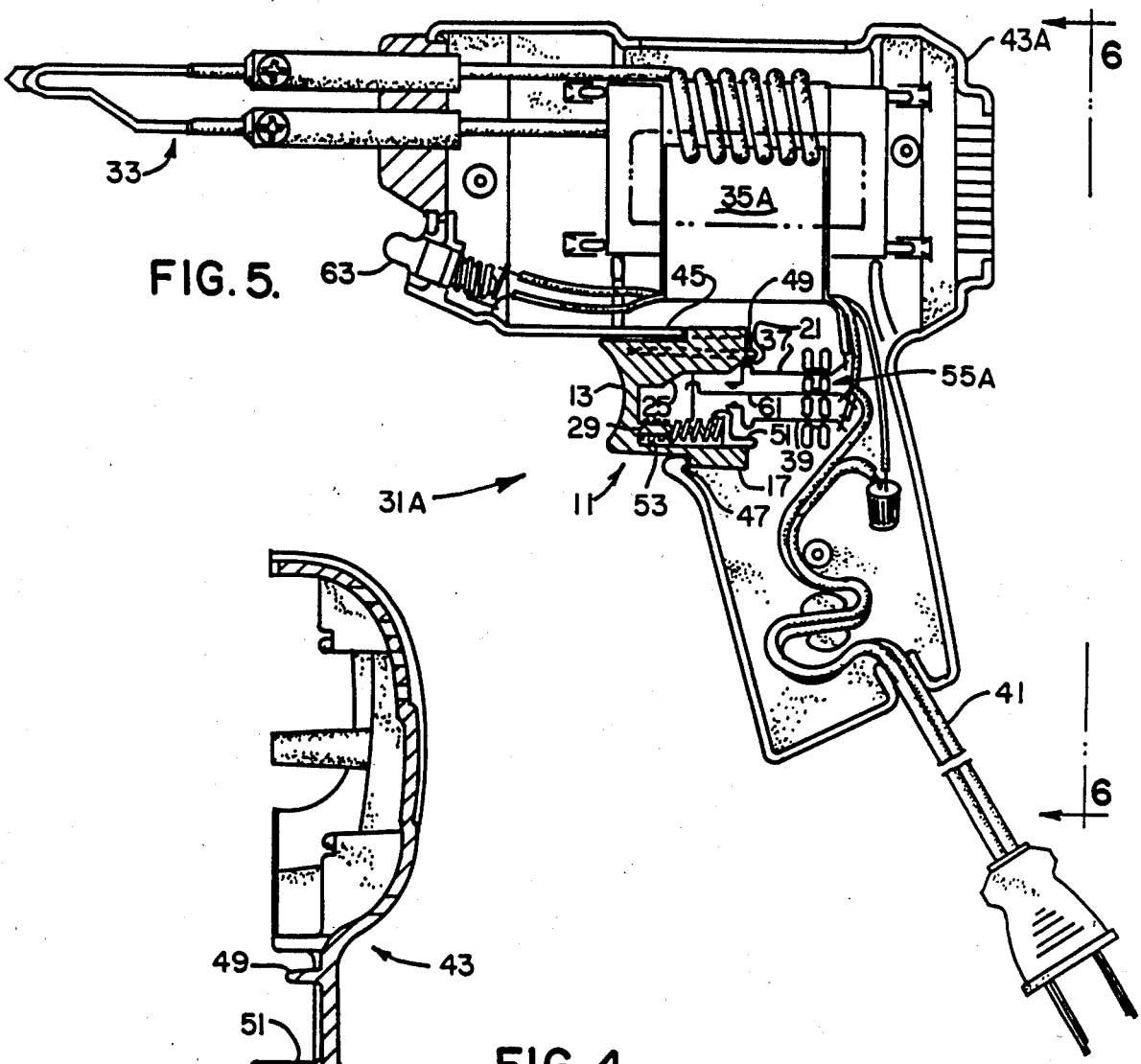
FIG. 5 is a cross sectional elevation similar to FIG. 3 of a two-temperature soldering iron incorporating the improved trigger and switch assembly of the present invention.
Figure 6:
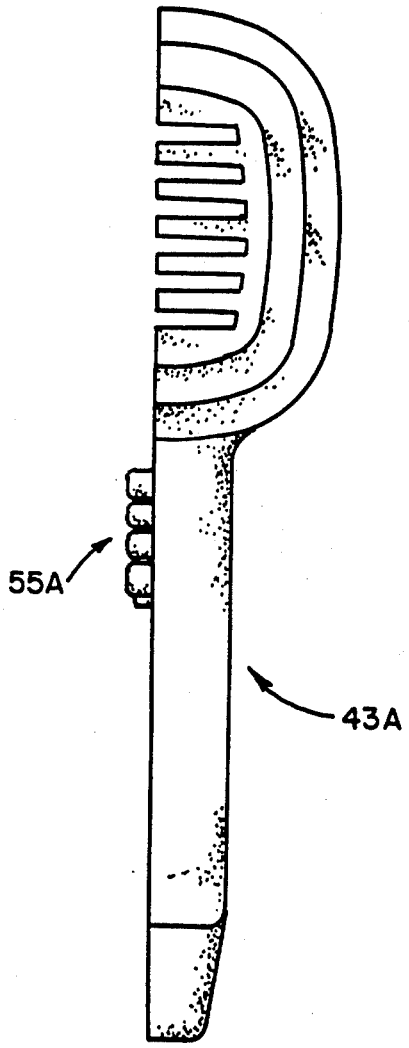
FIG. 6 is a rear elevation taken along line 6—6 of the apparatus of FIG. 5 with parts removed for clarity.
Figure 7:
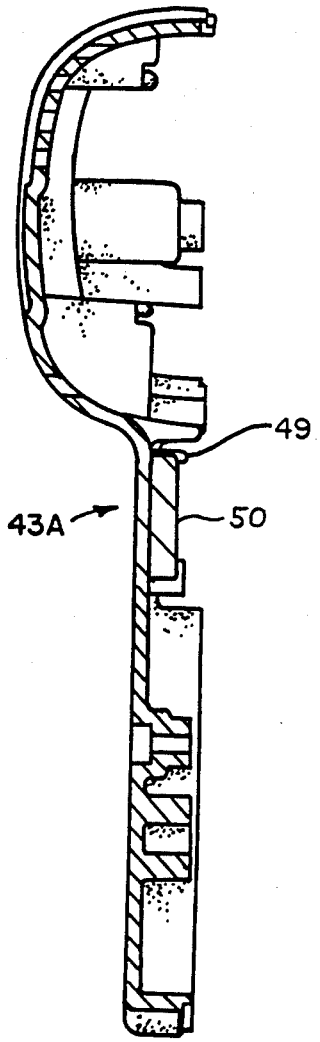
FIG. 7 is a cross sectional view of an electrical device housing half which mates with that of FIGS. 5 and 6 to mount the trigger and switch assembly of the present invention.

A related soldering iron 31A (FIG. 5–7) instead of being a single temperature iron such as iron 31, is a two-temperature iron. However, it differs only slightly from iron 31. Exactly the same trigger 11 is used in iron 31A as is used in iron 31. And the housing 43A of the two-temperature iron is very similar to the housing for the single temperature iron. Iron 31A differs mainly in having a transformer 35A with low and high power primary taps, mounting lugs 55A with four pairs of lugs instead of three (see especially FIG. 6), and a third electrical leaf spring contact 61. Of course other features of the two-temperature iron not having to do with the switch assembly or trigger could optionally be different as well. For example, the two-temperature iron features an indicator lamp 63. Like iron 31, iron 31A has guiding ribs 49 in both sides of the housing (see FIG. 7 for the second guiding rib). FIG. 7 also shows an integrally formed rib 50 which clamps the contacts in position in mounting lugs 55A.

In iron 31A (FIG. 5) first electrical contact 37 is still mounted by the mounting lugs 55A such that a relatively small amount of inward travel by trigger 11 causes contact 37 to be cammed downwardly. However, third contact 61 rather than second contact 39 is the contact which it physically engages when this happens. In this iron, contact 61 is disposed intermediate the first and second contacts, and so electrical contact is made between first contact 37 and third contact 61 upon initial movement of trigger 11. In fact, second contact 39 in this iron is mounted so far below first contact 37 that the first contact can never be cammed downwardly far enough to make physical contact with the second contact even if the third contact were to be removed. Further inward travel of trigger 11 causes third contact 61 to be cammed downwardly by second camming surface 25. That is, the distance between first contact 37 and first camming surface 21, as measured along the line of travel of trigger 11, is less than the distance between third contact 61 and second camming surface 25, so that as the trigger is depressed contact 37 is first cammed downwardly and then upon further movement of the trigger contact 61 is cammed downwardly. Camming surface 25 is generally the same shape as camming surface 21 but somewhat longer. Thus, the distance contact 61 is cammed downwardly by surface 25 is somewhat longer than the distance contact 37 had previously been cammed downwardly by camming surface 21. Thus, when third contact 61 is cammed downwardly by camming surface 25, it is first cammed out of physical engagement with first contact 37 and then cammed into physical engagement with the second contact. Second contact 39 is mounted by mounting lugs 55A a distance below third contact 61 such that the camming of the third contact by camming surface 25 causes the third contact to come into physical engagement with second contact 39. The actual spacing between the contacts as well as the size of the camming surfaces is chosen so that the physical and electrical contact between the first and third contacts is broken before contact between the second and third contacts is made. As can be seen from FIG. 5 first contact 37 and second contact 39 are generally the same length and are mounted by mounting lugs 55A to housing 43A at generally the same distance from the front of trigger 11. As can also be seen from FIG. 5, trigger 11 is hollowed out in such a manner that as the trigger is depressed contact 39 remains unengaged by the interior thereof, and more particularly remains unengaged by camming surfaces 21 and 25.

An iron 31A one of the two sides of line cord 41 is suitably connected to third contact 61 and the other is suitably connected to one side of the transformer primary. First contact 37 is suitably connected to the low heat tap of the transformer primary. And second contact 39 is suitably connected to the high heat tap of the transformer primary. As trigger 11 is pressed, camming surface 21 first makes electrical connection between the power cord and the lower het tap of the transformer and heating element 33 is heated to its low temperature. A predetermined further inward movement of trigger 11 breaks that circuit and closes the circuit between the line cord and the high heat tap of the transformer. Heating element 33 is thereupon heated to its high temperature. Once the trigger is released, return spring 53 returns the trigger to its off position in which both circuits are broken.

This particular construction of trigger 11 allows the same trigger and first and second electrical contacts to be used in two related, but different, soldering irons. The only changes that are required as part of the switch assembly are the addition of the third electrical contact and a different mounting lug arrangement in the housing itself. In addition, even for the two-temperature switch assembly, only the trigger, one spring, three electrical contacts and the soldering iron housing itself are required, which is a significant reduction in the number of parts required. Soldering iron housings 31 and 31A are thus seen to be interchangeable as far as trigger 11 and the first and second electrical contacts are concerned. If only on/off switching is desired, housing 31 is used. If two-temperature switching is desired, the other interchangeable housing 31A is used. The fact that the same parts are used for related soldering iron models provides a further savings in inventory costs. Moreover, the relatively simple construction of the switch assemblies makes them relatively low in cost and easy to assemble. Although this invention has been described with respect to soldering irons, it should be understood that it is equally applicable to other electrical devices such as electric drills and the like.

In view of the above, it will be seen that the various objects and features of the invention are achieved and other advantageous results are attained.

As various changes could be made in the above constructions without departing from the scope of the invention, it is intended that all matter contained in the above description or shown in the accompanying drawings shall be interpreted as illustrative and not in a limiting sense.

What is claimed is:

1. In an electrical device such as a soldering iron or an electric drill having a device housing, an improved device trigger comprising:

an integral trigger body having a finger receiving surface formed in one end thereof and forming the front of the trigger, the exertion of manual pressure on the finger receiving surface causing the trigger body to move inwardly with respect to the electrical device housing;

a first camming surface integrally formed in the trigger body, said first camming surface being disposed generally rearwardly with respect to the finger receiving surface and being shaped so as to force any electrical contact with which it becomes operatively engaged in a first direction;

a second camming surface integrally formed in the trigger body, said second camming surface being disposed between the first camming surface and the finger receiving surface and being further disposed in the first direction with respect to the first camming surface, said second camming surface being shaped so as to force any electrical contact with which it becomes operatively engaged in the first direction, away from any contact operatively engaged by the first camming surface;

guide means integrally formed in the trigger body for guiding the trigger in a relatively straight path with respect to the housing upon the application of manual pressure to the finger receiving surface; and a spring retention surface integrally formed in the trigger boy to retain one end of a return spring so that said return spring may force the trigger back to its rest position upon the removal of manual pressure.

2. The electrical device as set forth in claim 1 wherein the first camming surface originates generally at the rear of the trigger and slopes in the first direction and toward the front of the trigger therefrom.

3. The electrical device as set forth in claim 1 wherein the first camming surface terminates in a flat surface generally parallel to the line of travel of the trigger.

4. The electrical device as set forth in claim 3 wherein the second camming surface originates at the end of the flat surface closer to the front of the trigger and slopes in the first direction and toward the front of the trigger therefrom.

5. The electrical device as set forth in claim 1 wherein the second camming surface is spaced from the first camming surface a predetermined longitudinal distance.

6. The electrical device as set forth in claim 1 wherein the guide means includes a pair of grooves disposed parallel to the line of travel of the trigger to one side of the first and second camming surfaces.

7. The electrical device as set forth in claim 6 wherein the spring retention surface has an axis generally parallel to the line of travel of the trigger on the opposite side of the camming surfaces from the guide means.

8. The electrical device as set forth in claim 1 wherein the spring retention surface is a cone extending rearwardly from the direction of the finger receiving surface.

9. An interchangeable switching system for an electrical device such as a soldering iron or an electric drill comprising:

a trigger having a finger receiving surface formed in one end thereof;

first and second electrical contacts;

first and second interchangeable housing for mountably receiving the trigger and the contacts;

said trigger being movable inwardly with respect to the housing in which it is mounted by the application of manual pressure to the finger receiving surface;

said trigger having first and second camming surfaces accessible from inside the housing in which the trigger is mounted;

said first housing including means for mounting the first and second electrical contacts in positions in which inward movement of the trigger with respect to the first housing causes the first contact to engage the first camming surface, said first contact being forced by the first camming surface in a first direction perpendicular to the line of travel of the trigger, said second contact being disposed in the first direction with respect to first contact a distance no greater than the length of travel of the first contact, whereby engagement with the first camming surface causes the first and second electrical contacts to come into physical contact for the flow of current therethrough, said first housing mounting means disposing the second contact at such a position that it remains free of operative engagement of either camming surface of the trigger;

said second housing including means for mounting the first and second contacts in positions in which a predetermined inward movement of the trigger with respect to the second housing causing the first contact to engage the first camming surface, said first contact being forced by the first camming surface in the first direction, said second contact being disposed in the first direction with respect to the first contact a distance greater than the length of travel of the first contact, whereby the first and second contacts remain out of physical contact, further including a third electrical contact, said second housing mounting means including means for mounting the third contact intermediate the first and second contacts at a position in which the third contact is in physical contact with the first contact when the first contact is forced in the first direction by the first camming surface, said third contact being positioned such that an additional predetermined travel of the trigger inwardly causes the third contact to be engaged by the second camming surface, said second camming surface forcing the third contact in the first direction out of physical contact with the first electrical contact and into physical contact with the second electrical contact.

10. The switching system of claim 9 wherein the trigger includes an integrally formed spring retention surface, said first and second housings each including a corresponding spring abutting surface, further including a return spring operatively mounted on the spring retention surface and the spring abutting surface to force the trigger back to its rest position upon removal of manual pressure from the trigger.

11. The switching system as set forth in claim 9 wherein the trigger includes guide means for guiding the trigger along its line of travel with respect to either housing upon the application of manual pressure to the finger receiving surface, each of said housings further including track means for defining the line of travel of the trigger, the track means cooperating with the guide means to keep the trigger on a generally predefined line of travel.

12. The switching system as set forth in claim 11 wherein the guide means includes a pair of grooves, one on each side of the trigger, and the track means includes corresponding ribs extending inwardly from the housing walls to slidingly fit in the grooves.

13. The switching system as set forth in claim 9 wherein the first camming surface originates generally at the rear of the trigger and slopes in the first direction and toward the front of the trigger therefrom.

14. The switching system as set forth in claim 9 wherein the first camming surface terminates in a flat surface generally parallel to the line of travel of the trigger.

15. The switching system as set forth in claim 14 wherein the second camming surface originates at the end of the flat surface closer to the front of the trigger and slopes in the first direction and toward the front of the trigger therefrom.

16. The switching system as set forth in claim 9 wherein the second camming surface is spaced from the first camming surface a predetermined longitudinal distance.

17. The switching system as set forth in claim 9 wherein the trigger includes guide means for guiding the trigger along its line of travel with respect to either housing upon the application of manual pressure to the finger receiving surface, said trigger further having an integrally formed spring retention surface which has an axis generally parallel to the line of travel of the trigger on the opposite side of the camming surfaces from the guide means.

18. The switching system as set forth in claim 9 wherein the trigger includes an integrally formed spring retention surface consisting of a cone extending rearwardly from the direction of the finger receiving surface.

19. The switching system as set forth in claim 9 wherein the electrical contacts as disposed generally parallel to the line of travel of the trigger.

20. The switching system a set forth in claim 9 wherein the first and second electrical contacts are generally the same length and are mounted to either housing at generally the same distance from the front of the trigger, said trigger having an interior hollow to receive the second contact so that said contact remains unengaged by either camming surface.

21. The switching system as set forth in claim 9 wherein the third electrical contact extends forwardly with respect to the trigger further than the first and second electrical contacts.

22. The switching system as set forth in claim 9 wherein the distance between the first contact and the first camming surface, as measured along the line of travel of the trigger, is less than the distance between the third contact and the second camming surface.

23. A switching system incorporated in an electrical device such as a soldering iron or an electric drill comprising:

a trigger having a finger receiving surface formed in the front thereof;

first, second, and third electrical contacts;

a housing for mountably receiving the trigger and the contacts;

said trigger being movable inwardly with respect to the housing by the application of manual pressure to the finger receiving surface;

said trigger having first and second camming surfaces accessible from inside the housing;

said housing including means for mounting the first, second, and third electrical contacts in positions in which inward movement of the trigger a first distance with respect to the housing causes the first contact to engage the first camming surface, said first contact being forced by the first camming surface in a first direction, said second and third contacts being disposed in the first direction from the first contact, the third contact being disposed intermediate the first and second contacts at a position in which it is in physical contact with the first contact when the first contact is forced in the first direction by the first camming surface, said third contact being positioned such that an additional inward movement of the trigger a predetermined distance causes the third contact to be engaged by the second camming surface, said second camming surface forcing the third contact out of physical contact with the first electrical contact and into physical contact with the second electrical contact.

24. The switching system of claim 23 wherein the trigger includes an integrally formed spring retention surface, said housing including a corresponding spring abutting surface, further including a return spring operatively mounted on the spring retention surface and the spring abutting surface to force the trigger back to its rest position upon removal of manual pressure from the trigger.

25. The switching system as set forth in claim 23 wherein the trigger includes guide means for guiding the trigger along its line of travel with respect to the housing upon the application of manual pressure to the finger receiving surface, said housing further including track means for defining the line of travel of the trigger, the track means cooperating with the guide means to keep the trigger on a generally predefined line of travel.

26. The switching system as set forth in claim 25 wherein the guide means includes a pair of grooves, one on each side of the trigger, and the track means includes corresponding ribs extending inwardly from the housing walls to slidingly fit in the grooves.

27. The switching system as set forth in calim 23 wherein the first camming surface originates generally at the rear of the trigger and slopes in the first direction and toward the front of the trigger therefrom.

28. The switching system as set forth in claim 23 wherein the first camming surface terminates in a flat surface generally parallel to the line of travel of the trigger.

29. The switching system as set forth in claim 28 wherein the second camming surface originates at the end of the flat surface closer to the front of the trigger and slopers in the first direction and toward the front of the trigger therefrom.

30. The switching system as set forth in claim 23 wherein the second camming surface is spaced from the first camming surface a predetermined longitudinal distance.

31. The switching system as set forth in claim 23 wherein the trigger includes guide means for guiding the trigger along its line of travel with respect to either housing upon the application of manual pressure to the finger receiving surface, said trigger further having an integrally formed spring retention surface which has an axis generally parallel to the line of travel of the trigger on the opposite side of the camming surfaces from the guide means.

32. The switching system as set forth in claim 23 wherein the trigger includes an integrally formed spring retention surface consisting of a cone extending rearwardly from the direction of the finger receiving surface.

33. The switching system as set forth in claim 23 wherein the electrical contacts are disposed generally parallel to the line of travel of the trigger.

34. The switching system as set forth in claim 23 wherein the first and second electrical contacts are generally the same length and are mounted to the housing at generally the same distance from the front of the trigger, said trigger having an interior hollow to receive the second contact so that said contact remains unengaged by either camming surface.

35. The switching system as set forth in claim 23 wherein the third electrical contact extends forwardly with respect to the trigger further than the first and second electrical contacts.

36. The switching system as set forth in claim 23 wherein the distance between the first contact and the first camming surface, as measured along the line of travel of the trigger, is less than the distance between the third contact and the second camming surface.

* * * * *

UNITED STATES PATENT AND TRADEMARK OFFICE

CERTIFICATE OF CORRECTION

PATENT NO. : 4,700,031

DATED : October 13, 1987

INVENTOR(S) : Claghorn et al

It is certified that error appears in the above—identified patent and that said Letters Patent is hereby corrected as shown below:

Background Of The Invention

Column 1, Line 20 is "fast" should be "fact"

Summary Of The Invention

Column 2, Line 6 is "trigge" should be "trigger"
Column 2, Line 34 is "cuases" should be "causes"

Brief Description Of The Drawings

Column 4, Line 6 is "cammind" should be "camming"
Column 4, Line 13 is "iron (FIG. 3)" should be "iron 31 (FIG. 3)"
Column 4, Line 65 is "flow" should be "flows"
Column 6, Line 11 is "het" should be "heat"

Claims

Claim 1 Column 7, Line 16 is "boy" should be "body"
Claim 27, Column 10, Line 29 is "calim" should be "claim"
Claim 29, Column 10, Line 41 is "slopers" should be "slopes"

Signed and Sealed this

Twelfth Day of April, 1988

*Attest:*

DONALD J. QUIGG

*Attesting Officer*

*Commissioner of Patents and Trademarks*